US008755702B2

(12) United States Patent
Takeda

(10) Patent No.: US 8,755,702 B2
(45) Date of Patent: Jun. 17, 2014

(54) IMAGE FORMING APPARATUS AND TONER REPLENISHING METHOD

(75) Inventor: Kazuhisa Takeda, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 304 days.

(21) Appl. No.: 13/220,907

(22) Filed: Aug. 30, 2011

(65) Prior Publication Data

US 2012/0170949 A1 Jul. 5, 2012

Related U.S. Application Data

(60) Provisional application No. 61/428,335, filed on Dec. 30, 2010.

(30) Foreign Application Priority Data

Apr. 8, 2011 (JP) ..... P2011-086061

(51) Int. Cl.
*G03G 15/06* (2006.01)

(52) U.S. Cl.
USPC ..... 399/62; 399/58

(58) Field of Classification Search
USPC ..... 399/53, 58, 62, 30
See application file for complete search history.

(56) References Cited

U.S. PATENT DOCUMENTS

| | | | | |
|---|---|---|---|---|
| 6,501,933 | B2 * | 12/2002 | Ishii | |
| 6,539,183 | B2 * | 3/2003 | Ishimizu et al. | |
| 2009/0317105 | A1 * | 12/2009 | Tsutsumi et al. | 399/53 |
| 2010/0111553 | A1 * | 5/2010 | Sasaki et al. | |
| 2011/0182605 | A1 * | 7/2011 | Otsuka et al. | |

FOREIGN PATENT DOCUMENTS

| | | | | |
|---|---|---|---|---|
| JP | 11038700 | A | * | 2/1999 |
| JP | 2002062696 | A | * | 2/2002 |
| JP | 2005156589 | A | * | 6/2005 |
| JP | 2005156791 | A | * | 6/2005 |

* cited by examiner

*Primary Examiner* — Susan Lee
(74) *Attorney, Agent, or Firm* — Amin, Turocy & Watson, LLP

(57) ABSTRACT

An image forming apparatus that includes an exposure portion to expose a surface of an image carrier to form an electrostatic latent image; a developing device which includes an agitating roller to agitate developer, a developing roller to transfer toner of the developer on a surface of the image carrier and a toner concentration sensor to detect a toner concentration, the developing device developing the electrostatic latent image formed on the image carrier to form a toner image; a drive source to independently drive to rotate the developing roller and the agitating roller; and a control unit to control the drive source to change a rotational frequency of at least one of the developing roller and the agitating roller depending on the toner concentration detected by the toner concentration sensor.

16 Claims, 8 Drawing Sheets

RELATION BETWEEN ROTATION RATIO OF AGITATING ROLLER TO DEVELOPING ROLLER AND TONER RECOVERY TIME AT NORMAL REPLENISHMENT TIME

RELATION BETWEEN ROTATION RATIO OF AGITATING ROLLER TO DEVELOPING ROLLER AND TONER RECOVERY TIME AT FORCED REPLENISHMENT TIME

IMAGE FORMING APPARATUS AND TONER REPLENISHING METHOD

CROSS-REFERENCE TO RELATED APPLICATIONS

This application is based upon and claims the benefit of priority from the prior U.S. Patent Application No. 61/428,335, filed on Dec. 30, 2010, the entire contents of which are incorporated herein by reference. This application is also based upon and claims the benefit of priority from the prior Japanese Patent Application No. 2011-086061, filed on Apr. 8, 2011, the entire contents of which are incorporated herein by reference.

FIELD

Embodiments described herein relate to an image forming apparatus and a toner replenishing method.

BACKGROUND

Image forming apparatuses are known in which, at the time of replenishing developer during a toner exchanging operation or in the case where images with a high print ratio have been printed continuously, toner corresponding to the consumed toner is replenished from a toner cartridge so as to keep the ratio of the toner to the carrier in the developer constant. However, when the amount of the toner to be replenished is large, there is a problem that the carrier and the toner are not agitated sufficiently, and thereby the sufficient charging amount of toner can not be obtained.

DETAILED DESCRIPTION

An object regarding to one aspect of embodiments is that toner obtains a charging amount.

According to one embodiment, there is provided an image forming apparatus, comprising, an exposure portion to expose a surface of an image carrier to form an electrostatic latent image; a developing device which includes an agitating roller to agitate developer, a developing roller to transfer toner of the developer on a surface of the image carrier and a toner concentration sensor to detect a toner concentration, said developing device developing the electrostatic latent image formed on the image carrier to form a toner image; a drive source to independently drive to rotate the developing roller and the agitating roller; and a control unit to control the drive source to change a rotational frequency of at least one of the developing roller and the agitating roller depending on the toner concentration detected by the toner concentration sensor.

Hereinafter, embodiments of an image forming apparatus will be described with reference to the accompanied drawings.

A first embodiment controls a developing roller and agitating rollers to be driven independently, and changes a ratio of the rotational frequency of the agitating rollers to that of the developing roller depending on a toner concentration.

Figure 1:
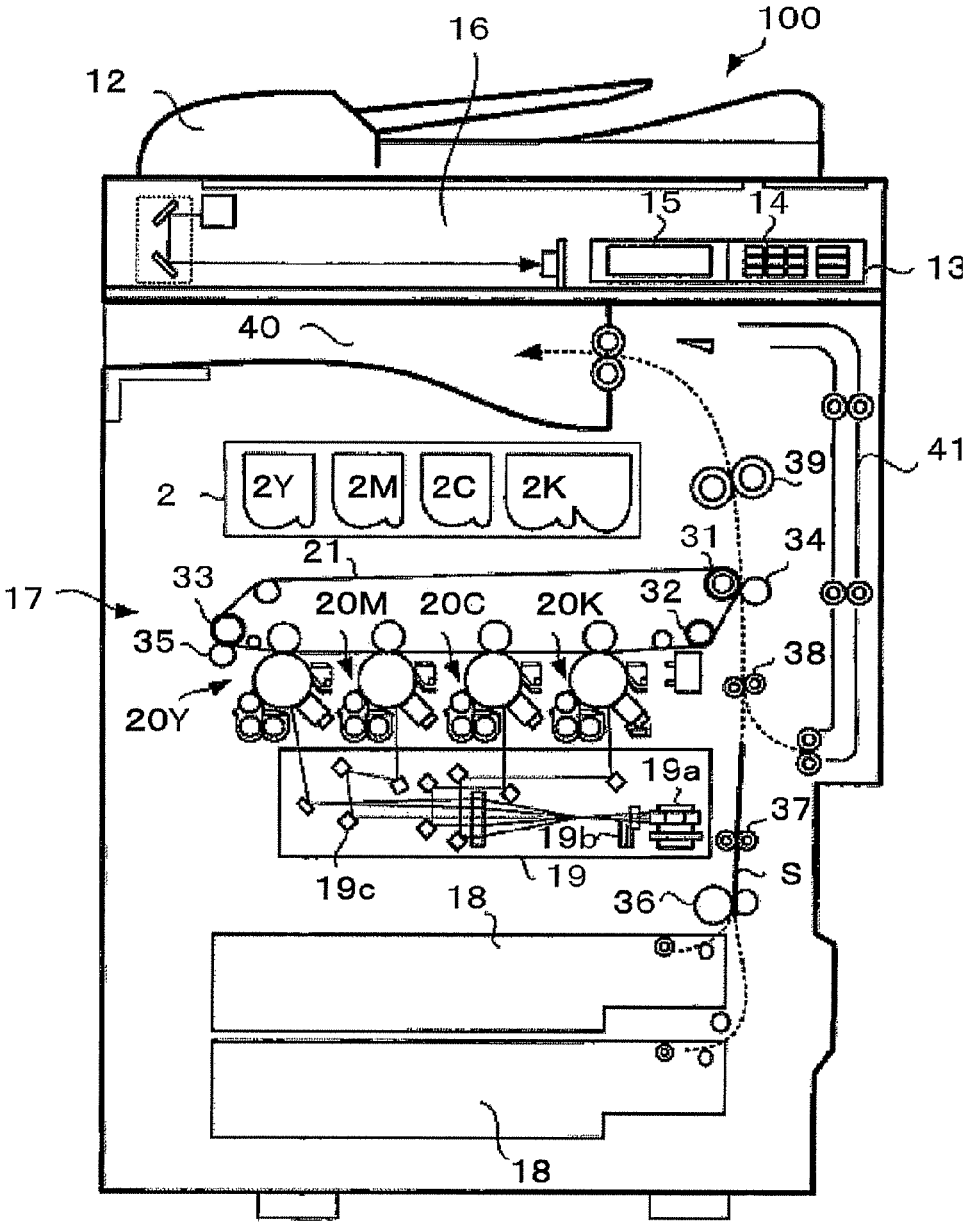
FIG. 1 is a construction view showing an image forming apparatus in a first embodiment.

FIG. 1 is a construction view showing an image forming apparatus of a first embodiment. In FIG. 1, a symbol 100 is an image forming apparatus, such as an MFP (Multi-Function Peripherals) that is a complex machine, a printer, and a copier. In the following description, an MFP will be described as an example.

The MFP 100 has an automatic document feeder (ADF) 12, an operation panel 13, a scanner portion 16, a printer portion 17, a sheet feeding cassette (sheet feeder) 18 and a sheet discharger 40.

The ADF 12 is provided on a document table to open and close freely, and automatically conveys a document. The operation panel 13 has an operating portion 14 having various keys and a display potion 15 of a touch panel system.

The scanner portion 16 is provided below the ADF 12, and reads the document sent by the ADF 12 or the document positioned on the document table and forms image data. The scanner portion 16 is an example of an input portion of a print document. In addition to this, it is possible that this input portion receives an image data of a document which is made up by a PC (Personal Computer) as an external terminal. At the time point the input portion receives the image data, a print ratio of the sheet is detected based on the pixels of the image data. The print ratio is determined as a ratio of the printing image pixel to the total image pixel of one page on which an image forms.

The sheet feeding cassette 18 has a plurality of cassettes to house sheets S of various sizes, respectively. The sheet discharger 40 houses the sheet S which the image has been formed on and is discharged.

The printer portion 17 includes image forming portions, and a laser exposure device which will be described later, and so on, and processes the image data read out with the scanner portion 16 and the image data made up with the PC and so on to form an image on the sheet S. The sheet on which the image has been formed by the printer portion 17 is discharged to the sheet discharger 40. The printer portion 17 is a color laser printer of a four-tandem system, and scans photo conductors of image forming portions with laser beams from a laser exposure device 19, respectively, to form an image.

The laser exposure device 19 includes a polygon mirror 19*a*, an imaging lens system 19*b* and mirrors 19*c*, and scans each of rotating photo conductor drums 22 in the axis line direction with a laser beam which is emitted from a semiconductor laser device and modulated based on the image data.

The printer portion 17 includes image forming portions 20Y, 20M, 20C, 20K of respective colors of yellow (Y), magenta (M), cyan (C), black (B). The image forming portions 20Y, 20M, 20C, 20K are arranged below an intermediate transfer belt 21, from the upstream side to the downstream side.

Figure 2:
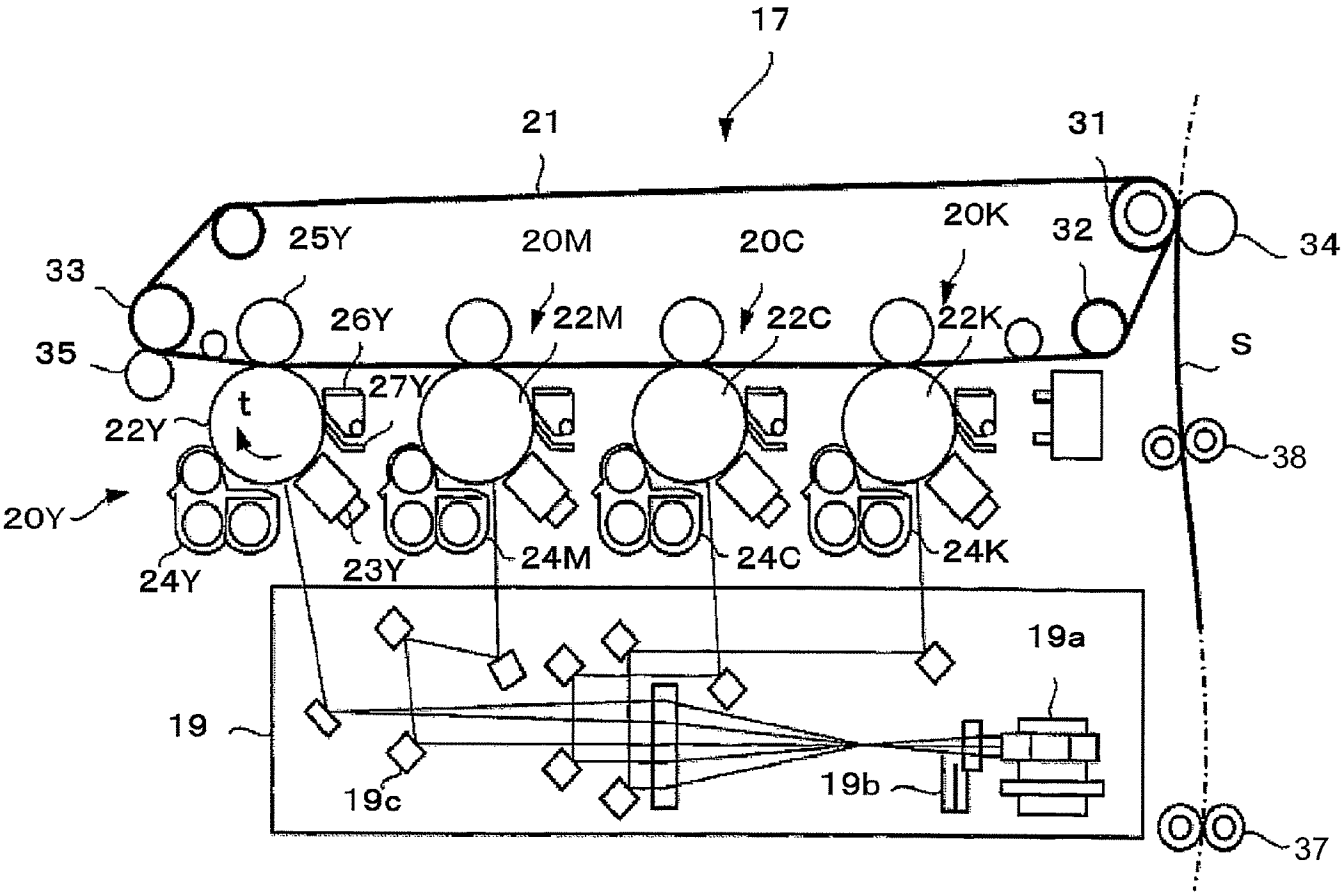
FIG. 2 is a construction view showing an internal construction of the image forming apparatus in the first embodiment.

FIG. 2 is an enlarged view showing the printer portion 17 including the image forming portions 20Y, 20M, 20C, 20K. In the following description, as each of the image forming portions 20Y, 20M, 20C, 20K has the same construction, the image forming portion 20Y will be described as a representative.

The image forming portion 20Y has a photo conductor drum 22Y that is an image carrier, and also has a charger 23Y, a developing device 24Y, a primary transfer roller 25Y, a cleaner 26Y and a blade 27Y which are arranged around the photo conductor drum 22Y along a rotation direction t. The photo conductor drum 22Y is irradiated at the exposure position with a laser beam which is modulated based on the image data corresponding to the yellow from the laser exposure device 19, to thereby form an electrostatic latent image on the photo conductor drum 22Y.

The charger 23Y of the image forming portion 20Y uniformly charges the whole surface of the photo conductor drum 22Y. The surface of the photoconductor drum 22Y thus charged is irradiated with the above-described laser beam to thereby form the electrostatic latent image. The developing device 24Y stores two-component developer composed of yellow toner and carrier, and supplies the yellow toner to the photo conductor drum 22Y by a developing roller to which a developing bias is applied. The electrostatic latent image on the photo conductor drum 22Y is developed (to a toner image) by the supplied toner. After a transfer process describe later, the cleaner 26Y removes the residue toner on the surface of the photo conductor drum 22Y using the blade 27Y.

As shown in FIG. 1, a toner cartridge 2 (developer containing portion) to supply toners to the respective developing devices 24Y, 24M, 24C, 24K is provided above the image forming portions 20Y, 20M, 20C, 20K. In the toner cartridge 2, toner cartridges 2Y, 2M, 2C, 2K of respective colors of yellow (Y), magenta (M), cyan (C), black (K) are provided side-by-side. Out of the toner cartridges of each color, only the cartridge 2K of black (K) has a larger capacity. This is because the consumption of the black toner is largest in the ordinary image forming.

In FIG. 1 and FIG. 2, the endless intermediate transfer belt 21 moves in a circulating manner, and a semi-conductive polyimide is used for it, for example, from the points of the heat tolerance and abrasion resistance. The intermediate transfer belt 21 is wound around a drive roller 31 and driven rollers 32, 33, and faces and contacts the photo conductor drums 22Y, 22M, 22C, 22K. A primary transfer voltage is applied from the first transfer roller 25Y to the intermediate transfer belt 21 at the position facing the photo conductor drum 22Y, and thereby the toner image on the photo conductor drum 22Y is primarily transferred to the intermediate transfer belt 21.

A secondary transfer roller 34 is arranged to face the drive roller 31 around which the intermediate transfer belt 21 is wound. While the sheet S passes between the intermediate transfer belt 21 and the secondary transfer roller 34, a secondary transfer voltage is applied to the sheet S by the secondary transfer roller 34 to thereby cause the toner image on the intermediate transfer belt 21 to be secondarily transferred on the sheet S. In the vicinity of the driven roller 33 of the intermediate transfer belt 21, a belt cleaner 35 is provided to clean (the residue toner) which has not been transferred to the sheet S in the secondary transfer process.

In addition, as shown in FIG. 1, a separation roller 36 to take out the sheet S in the sheet feeding cassette 18, conveying rollers 37, resist rollers 38 are provided at the path from the sheet feeding cassette 18 to the secondary transfer roller 34, and a fixing device 39 is provided at the downstream of the secondary transfer roller 34.

At the downstream of the fixing device 39, the sheet discharger 40 and an inversion conveying path 41 are provided. The sheet S on which the toner image has been fixed by the fixing device 39 is discharged to the sheet discharger 40. The inversion conveying path 41 inverts and leads the sheet S in the direction of the secondary transfer roller 34, and is used at the time of double face printing.

Figure 3:
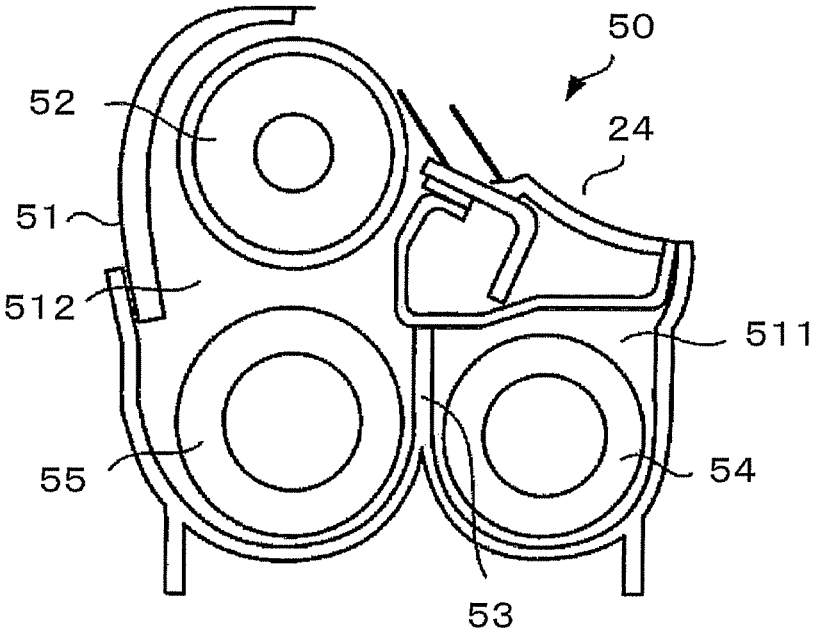
FIG. 3 is a front sectional view showing a developing device of the image forming apparatus in the first embodiment.

FIG. 3 is a front sectional view showing a construction of a developing device 50. The developing device 50 includes the developing devices 24Y, 24M, 24C, 24K, but as the respective developing devices have the same construction, the symbols of Y, M, C, K will be omitted in the following description.

As shown in FIG. 3, the developing device 24 has a developing container 51. The developing container 51 is arranged approximately in parallel along the axis direction of the photo conductor drum 22, and the developing container 51 has a developing roller 52 which is rotatable.

The developing roller 52 has a magnet inside, is also called as a magnet roller, and is arranged facing and close to the photo conductor drum 22. Carrier and toner are supported on the surface of the developing roller 52 by the magnet at the inside, and the developing roller 52 rotates to supply the toner to the photo conductor drum 22. The rotational frequency of the developing roller 52 depends on the rotational frequency of the photo conductor drum 22. The rotational frequency of the developing roller 52 is about 1.8 times, for example, compared with the rotational frequency of the photo conductor drum 22.

The developing container 51 is partitioned into two spaces 511, 512 with a partition plate 53, and two-component developer, that is to say, toner and carrier are replenished in one space 511. The toner and carrier which are replenished into the space 511 are to be supplied to the space 512.

In one space 511 of the developing container 51, an agitating roller 54 to compose a first mixer is provided, and in the other space 512 in which the above-mentioned developing roller 52 is provided, an agitating roller 55 to compose a second mixer is provided. The agitating rollers 54, 55 respectively agitate the developer (carrier and toner) in the developing container 51 to supply the developer to the developing roller 52, and circulate the developer in the space 511 and the space 512. The developer is circulated in the developing container 51 in such a manner that the developer is conveyed in the direction from the front side to the back side in the space 512 in FIG. 3, and the developer is conveyed in the direction from the back side to the front side in the space 511.

The developing device 51 has a toner concentration ratio sensor 56 in the space 511, and detects a toner concentration ratio of the developer to be agitated and conveyed by the agitating roller 54. When the toner concentration ratio detected by the toner concentration ratio sensor 56 becomes not more than a predetermined threshold value, the toner is replenished.

The toner concentration ratio sensor may be constructed as an optical sensor, a magnetic sensor or other electrical device. The toner concentration ratio is defined as the ratio of the weight of toner to the total weight of toner and carrier.

Figure 4:
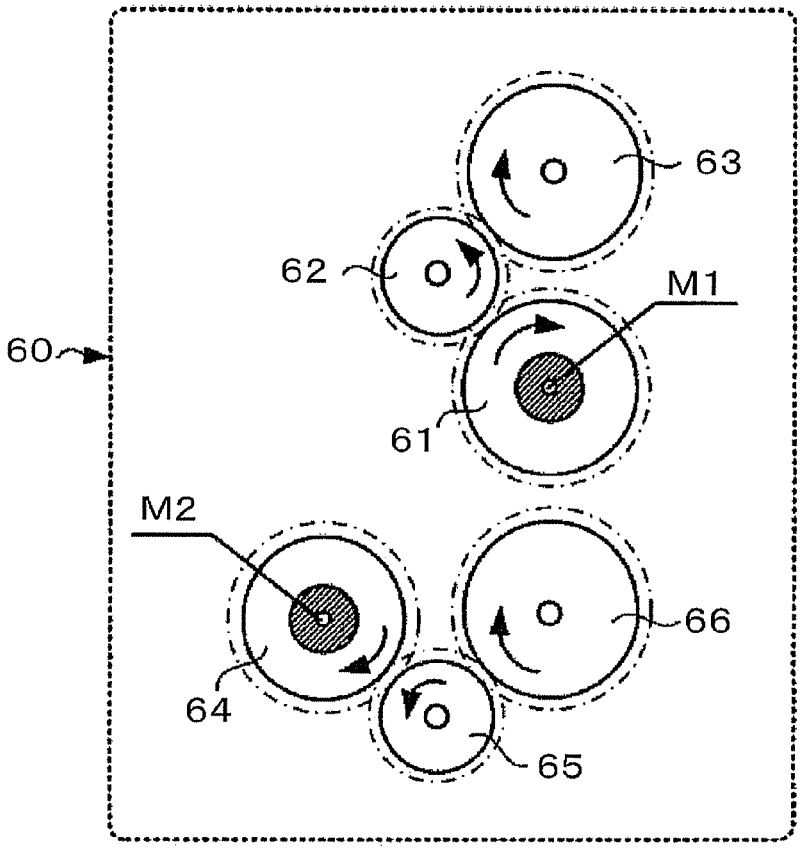
FIG. 4 is a rear view showing an example of a drive mechanism of a developing roller and a developer agitating portion of the developing device of the image forming apparatus in the first embodiment.

FIG. 4 shows a drive mechanism 60 (driving source) for the developing roller 52 and the agitating rollers 54, 55 which are included in the developing device 50. The drive mechanism 60 is provided at the back side of the developing device 24 in FIG. 3 so as to drive each of the rollers of the developing device 24 shown in FIG. 3.

In FIG. 4, the drive mechanism has separately a motor M1 to drive the developing roller 52 and a motor M2 to drive the agitating roller 54, 55. A gear 61 is fitted on a rotation axis of the motor M1, and in addition, a gear 62 which engages with the gear 61 to rotate, and a gear 63 which engages with the gear 62 to rotate are provided, and the developing roller 52 rotates by the rotation of the gear 63.

In addition, a gear 64 is fitted on a rotation axis of the motor M2, and a gear 65 which engages with the gear 64 to rotate, and a gear 66 which engages with the gear 65 to rotate are provided. The agitating roller 54 rotates by the rotation of the gear 64, and the agitating roller 55 rotates by the rotation of the gear 66.

Figure 5:
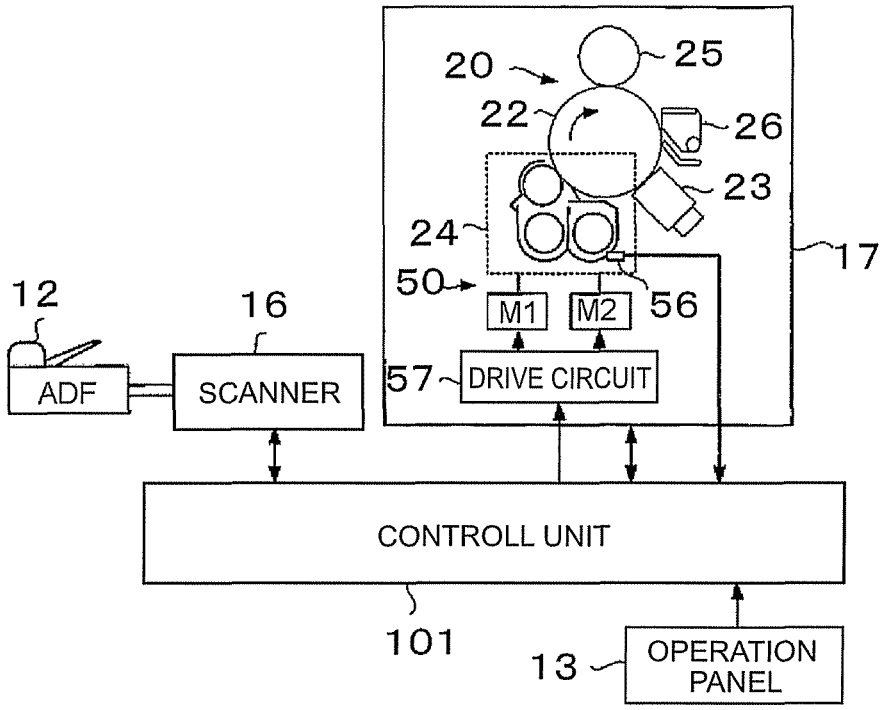
FIG. 5 is a block diagram showing a control system of the image forming apparatus in the first embodiment.

FIG. 5 is a block diagram showing a control system of the MFP 100, and mainly shows a control system of the developing device 50.

In FIG. 5, a control unit 101 includes a CPU, an RAM, an ROM and on on, and controls the operation of the whole MFP 100. The operation panel 13, the scanner portion 16 and the printer portion 17 are connected to the control unit 101 so that their operations are respectively controlled by the control unit 101. The image forming portion 20 of the printer portion 17 includes the photo conductor drum 22 that is the image carrier as described above, and the charger 23, the developing device 24, the first transfer roller 25, the cleaner 26 and so on are arranged around the photo conductor drum 22.

The motor M1 to drive the developing roller 52 of the developing device 24 and the motor M2 to drive the agitating rollers 54, 55 are independently controlled to be driven by a drive circuit 57, and the drive circuit 57 is controlled by the control unit 101. The developing device 24 includes the above-mentioned toner concentration ratio sensor 56. The toner concentration ratio sensor 56 detects the toner concentration ratio of the developer which is agitated and conveyed by the agitating roller 54, and supplies a detection result of the concentration to the control unit 101.

Next, the drive of the developing roller 52 and the agitating rollers 54, 55 at the toner replenishing time will be described. The toner replenishment has three modes of a normal replenishment, a forced replenishment, and a refresh replenishment. The normal replenishment time indicates a case in which an image of a low print ratio is printed, for example, and the toner concentration ratio of the developer is approximately constant, and to replenish a large amount of toner is not required. The droppage of the toner at the normal time is 24 mg for one sheet of an A4 size, if the print ratio is 6%, for example.

Figure 6:
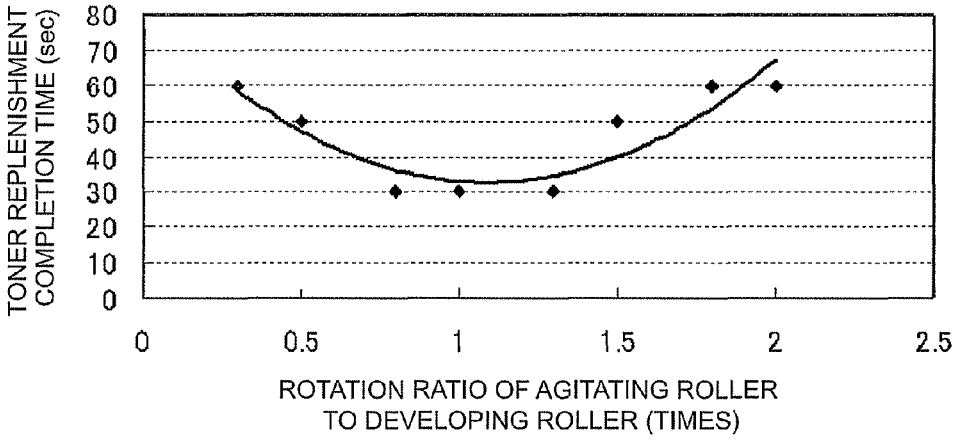
FIG. 6 is a graph showing the relation between a rotation ratio of agitating rollers to the developing roller and a toner recovery time at a normal replenishment time in the first embodiment.

FIG. 6 is a diagram showing the relation between a rotation ratio of the agitating rollers 54, 55 to the developing roller 52 and a toner recovery time at the normal replenishment time. This FIG. 6 shows a measurement result stated in the following. That is, when the rotational frequency of the agitating rollers 54, 55 is changed for the rotational frequency of the developing roller 52, toner replenishment completion times are measured for the respective ratios of the rotational frequency. The toner replenishment completion time is a time which is required till a toner concentration ratio that is a ratio of toner to carrier becomes a constant value that is 8.5%, for example. Here, the toner concentration ratio suitable for the image formation is assumed to be 8.5%. The charging amount which the toner obtains in the developing device 24 is previously determined depending on the toner concentration ratio, and the toner concentration ratio of 8.5% means that the charging amount suitable for the image formation can be obtained. From FIG. 6, when the ratio of the rotational frequency of the agitating rollers 54, 55 to the rotational frequency of the developing roller 52 is 1.0 times, a time till the toner replenishment completion is 30 seconds, and the processing is completed faster compared with the cases of other rotation ratios.

Consequently, at the normal replenishment time, about 1.0 times is suitable for the ratio of the rotational frequency of the agitating rollers 54, 55 to the rotational frequency of the developing roller 52. At the normal replenishment time, the developing roller 52 and the agitating rollers 54, 55 are rotated at 450 rpm.

In case that the ratio of the rotational frequency of the agitating rollers 54, 55 to that of the developing roller 52 is too low, a lot of time is required for the agitation of the toner and carrier in the developing device 24. On the other hands, in case that the ratio of the rotational frequency of the agitating rollers 54, 55 to that of the developing roller 52 is too high, the agitating rollers 54, 55 rotate too fast so that the toner which is replenished into augers which the agitating rollers 54, 55 respectively have hardly reach the lower portion of the developing device 24. As a result, the toner and the carrier are not agitated sufficiently and a lot of time is required till the charging amount suitable for the image formation is obtained.

When to replenish a large amount of toner is required, such as the toner forced replenishment time and the refresh replenishing time, the ratio of the rotational frequency of the agitating rollers 54, 55 to that of the developing roller 52 is changed.

Here, the toner forced replenishment time indicates a case that when images of high print ratio such as solid images are continuously printed and thereby the toner concentration ratio drops to 7%, for example, a large amount of toner is replenished from the toner cartridge 2 to the developing device 50 so as to recover the toner concentration ratio from 7.0% to 8.5%. Subsequently, the refresh replenishment time will be described. In case that image formation has not been performed for a long time or in case that the toner is hardly consumed because the images of low print ratio are printed, the toner remaining in the developing device 50 becomes so old that image formation can not be performed in good condition. The refresh indicates to consume the old toner in large amount by forming images of a high print ratio such as solid images using the old toner remaining in the developing device 50. At the refresh time, as the old toner is consumed in large amount, a large amount of new toner is replenished from the toner cartridge 2 to the developing device 50, and thereby the toner concentration ratio which has been decreased after the toner is consumed in large amount is recovered to 8.5%. This is defined as the refresh replenishment.

Figure 7:
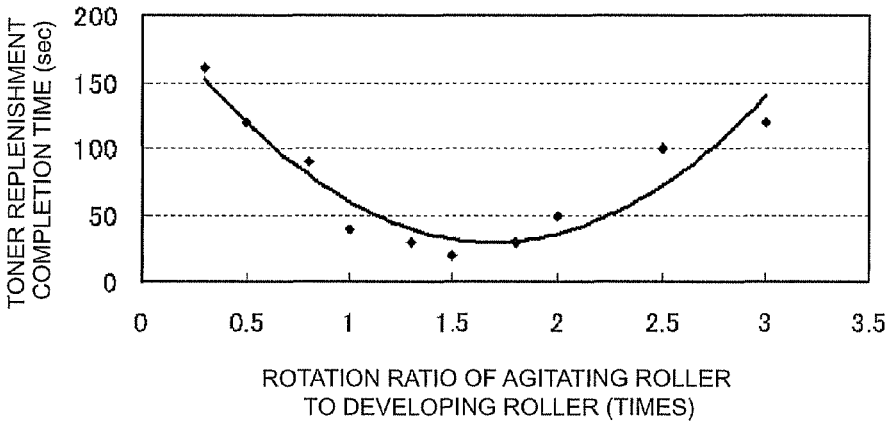
FIG. 7 is a graph showing the relation between a rotation ratio of the agitating rollers to the developing roller and a toner recovery time at a forced replenishment time in the first embodiment.

FIG. 7 is a diagram showing the relation between a rotation ratio of the agitating rollers 54, 55 to the developing roller 52 and a toner recovery time at the forced replenishment time. In the same manner as FIG. 6, the rotational frequency of the agitating rollers 54, 55 is changed for the rotational frequency of the developing roller 52, and toner replenishment completion times are measured for the respective ratios of the rotational frequency. The toner replenishment completion time is a time which is required till a toner concentration ratio that is a ratio of toner to carrier becomes a constant value that is 8.5%, for example. Here, the toner concentration ratio suitable for the image formation is assumed to be 8.5%. From FIG. 7, when the ratio of the rotational frequency of the agitating rollers 54, 55 to the rotational frequency of the developing roller 52 is 1.5 times, a time till the toner replenishment completion is about 20 seconds, and the processing is completed faster compared with the cases of other rotation ratios.

Consequently, at the time when a large amount of toner is to be replenished to the developing device 50, such as the forced replenishment time and the refresh replenishment time, about 1.5 times is suitable for the ratio of the rotational frequency of the agitating rollers 54, 55 to the rotational frequency of the developing roller 52. At the forced replenishment time, the developing roller 52 is rotated at 450 rpm, and the agitating rollers 54, 55 are rotated at 675 rpm, for example.

In case that the ratio of the rotational frequency of the agitating rollers 54, 55 to that of the developing roller 52 is too low or too high, the reason for requiring a lot of time till the charging amount suitable for the image formation is the same as the description in FIG. 6.

The motor M1 to rotate the developing roller 52' and the motor M2 to rotate the agitating rollers 54, 55 are independently controlled to be driven by the drive circuit 57, respectively. At the time of replenishing a large amount of toner to the developing device 50, the drive circuit 57 varies the rotation speeds, and rotates the motor M2 to drive the agitating rollers 54, 55 at the rotational frequency of about 1.5 times compared with the motor M1 to drive the developing roller 52. The developing roller 52 is rotated at the same rotational frequency as at the normal replenishment printing time.

The toner contained in the toner cartridge 2 is not charged. After the toner is replenished from the toner cartridge 2 to the developing device 24, the toner is agitated along with the carrier by the agitating rollers 54, 55 and is thereby charged. At the time of replenishing a large amount of toner from the toner cartridge 2 to the developing device 50, the toner having the charging amount close to that immediately after the replenishment is developed on the photo conductor drum 22 via the developing roller 52. In this time, if the agitation of the toner is not performed sufficiently, the development is to be performed with the toner in a insufficiently charged state.

Here, as in the present embodiment, at the time of replenishing a large amount of toner to the developing device 50, the toner is sufficiently agitated by the agitating rollers 54, 55 at the preceding process in which the toner is supplied to the photo conductor drum 22, by making the rotational frequency of the agitating rollers 54, 55 about 1.5 times for the rotational frequency of the developing roller 52.

At the normal printing time, the toner concentration ratio immediately after the replenishment and agitation is kept 8.5%, and even if the agitating rollers 54, 55 are rotated at the rotational frequency of about 1.0 times for the rotational frequency of the developing roller 52, the toner is sufficiently charged.

Figure 8:
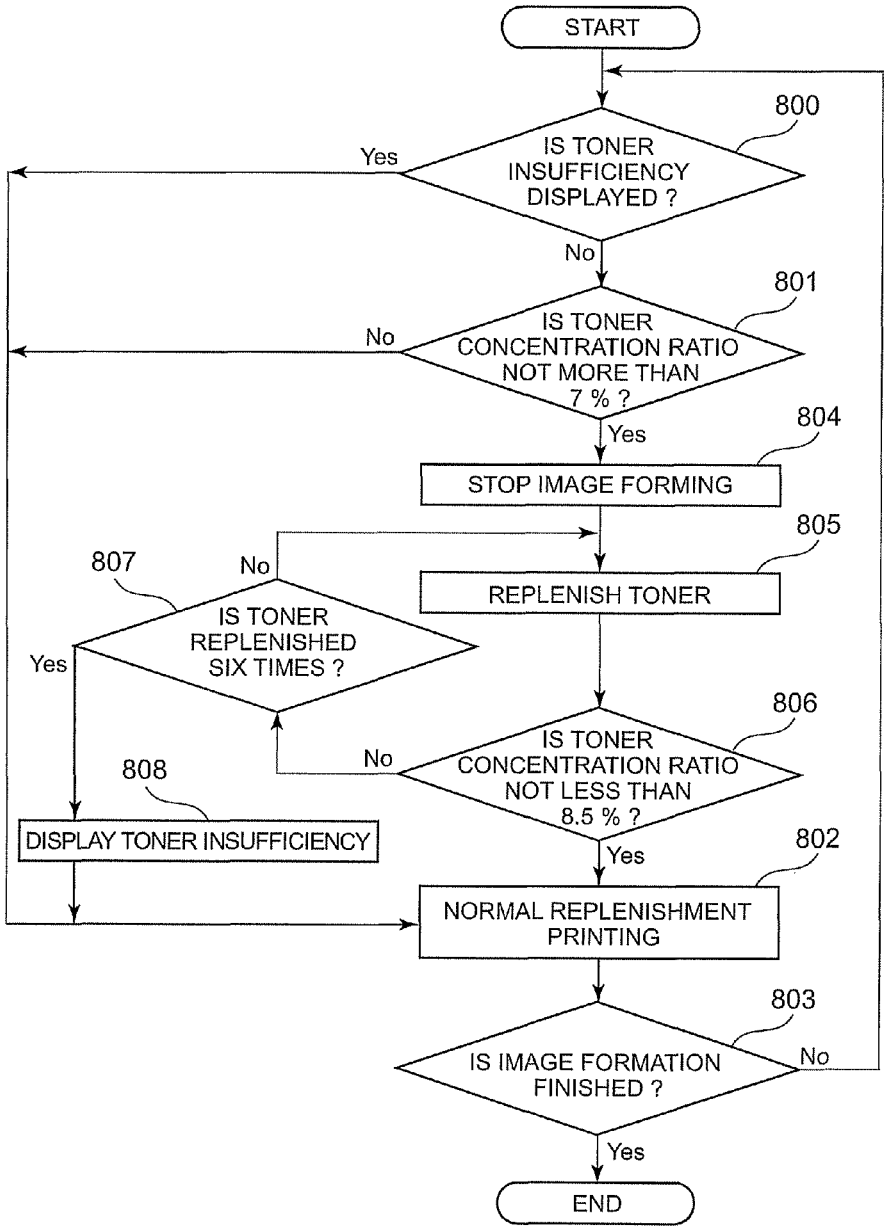
FIG. 8 is a flow chart of toner replenishment in the first embodiment.

Next, a flow of the toner replenishment will be described using FIG. 8. In 800, whether or not that the toner in the toner cartridge 2 is in an approximately empty state has been displayed on the display portion 15 is judged. If a large amount of the toner is present in the toner cartridge 2 (No in 800), whether or not the toner concentration ratio is not more than 7% (first threshold value) is judged in 801. The toner concentration ratio sensor 56 detects the toner concentration ratio. Unless the toner concentration ratio is not more than 7% (No in 801), the normal replenishment printing is performed in 802. At the normal replenishment time, the ratio of the rotational frequency of the agitating rollers 54, 55 to the rotational frequency of the developing roller 52 is about 1.0 times. In 803 whether or not the image forming has been finished is judged, and if the image forming has not been finished (No in 803), the processing returns to 800, and the processing is repeated till the image formation is finished (Yes in 803)

If the toner concentration ratio is not more than 7% (Yes in 801), that to replenish toner in a large amount is required is judged, and the image formation is stopped in 804, and the toner is replenished in 805. The replenishment of the toner in 805 corresponds to the replenishment at the forced replenishment time or the refresh replenishment time. In this time, the agitating rollers 54, 55 are rotated at the rotational frequency with a ratio of about 1.5 times to the rotational frequency of the developing roller 52. In the toner replenishing operation, the toner is replenished from the toner cartridge 2 to the developing device 50 for six seconds, and the toner replenishment is stopped for seven seconds so as to agitate the developer. The operation that the toner is replenished for six second and the toner replenishment is stopped for seven seconds is repeated six times.

After the toner is replenished, whether or not the toner concentration ratio is not less than 8.5% (second threshold value) is judged in 806. If the toner concentration ratio is not less than 8.5% (Yes in 806), the normal replenishment printing is performed in 802. Unless the toner concentration ratio is not less than 8.5% (No in 806), whether or not the toner replenishment is repeated 6 times is judged in 807. If the toner replenishment is not repeated three times (No in 807), the toner replenishment is repeated in 805.

If the toner replenishment is repeated 6 times (Yes in 807), that the toner in the toner cartridge 2 is insufficient is displayed on the display portion 15 in 808. Even if the toner in the toner cartridge 2 is insufficient, as several tens of sheets can be printed, the normal replenishment printing is performed in 802. After that the toner in the toner cartridge 2 is insufficient is displayed, about 50 sheets can be printed in black (K), for example. If that the toner is insufficient has been displayed (Yes in 800), the normal replenishment printing is performed in 802. In 803, the processing is returned to 800, and the processing is repeated till the image formation is finished.

In the above description, the embodiment is described in which at the time the replenishment of a large amount of toner is required such as at the toner forced replenishment time and the refresh replenishment time, the rotational frequency of the developing roller 52 is not changed from that at the normal replenishment time, but the rotational frequency of the agitating rollers 54, 55 is changed to about 1.5 times the rotational frequency of the developing roller 52. But without being limited to the above-described embodiment, a construction may be used in which the rotational frequency of the agitating rollers 54, 55 is not changed, but the rotational frequency of the developing roller 52 is made ⅔ times the rotational frequency of the agitating rollers 54, 55.

In addition, at the time the replenishment of a large amount of toner is required, the rotational frequency of the agitating rollers 54, 55 is not limited to 1.5 times the rotational frequency of the developing rollers 52, but may be in a range of 1~2.5 times.

By providing the image forming apparatus in which the rotational frequency of the agitating rollers 54, 55 is changed for the rotational frequency of the developing roller 52 depending on the toner replenishment amount in this manner to a user, at the time the replenishment of a large amount of the toner is required, a localized change in the toner concentration ratio can be suppressed, and thereby the toner can obtain a sufficient charging amount. In addition, the toner replenishing time can be shortened.

Second Embodiment

A second embodiment controls the developing roller and the agitating rollers to be driven independently, and changes the ratio of the rotational frequency of the agitating rollers to that of the developing roller depending on a process speed.

The same symbols are given to the same constituent portions as in the first embodiment.

The process speed depends on the rotational frequency of the photo conductor drum 22, and indicates how many image formations can be made in one minute. At the time of forming an image on a heavy paper, the process speed is dropped down compared with a plain paper. The process speed is 200 mm/sec for a plain paper, and is 75 mm/sec for a heavy paper, for example. If the process speed is faster compared with a case in which the process speed is slow, the hourly toner consumption is larger. The more the toner consumption is, the more the toner replenishment amount becomes.

Accordingly, at the time of replenishing the toner to a plain paper requiring a large hourly toner consumption, the rotational frequency of the agitating rollers 54, 55 is determined to be 1.5~2.0 times the rotational frequency of the developing roller 52. At the time of replenishing the toner to a heavy paper requiring a small hourly toner consumption, the rotational frequency of the agitating rollers 54, 55 is determined to be 1.0 times the rotational frequency of the developing roller 52.

Not depending on the kind of the sheet such as a plain paper and a heavy paper, but the ratio of the rotational frequency of the agitating rollers to that of the developing roller may be changed depending on the process speed. Further, the faster the process speed is, the higher the revolutions per minutes of the agitating roller are.

By providing the image forming apparatus in which the rotational frequency of the agitating rollers 54, 55 is changed for the rotational frequency of the developing roller 52 depending on the process speed in this manner to a user, at the time the replenishment of a large amount of the toner is required, a localized change in the toner concentration ratio can be suppressed, and thereby the toner can obtain a sufficient charging amount. In addition, the image deterioration such as toner scattering and the tone reproducibility can be suppressed and to shorten the toner replenishing time can be expected.

In addition, the revolutions per minutes of the agitating roller may be changed according to the elapse time from the starting time of the first use of toner in the toner cartridge to the current time. For example, the longer the elapse time is, the higher the revolutions per minutes of the agitating roller are.

Further, this second embodiment can be processed by itself. In addition to that, this process of the second embodiment may be combined to the process of the first embodiment.

Third Embodiment

A third embodiment controls the developing roller and the agitating rollers to be driven independently, and changes the ratio of the rotational frequency of the agitating rollers to that of the developing roller depending on a print rate. The same symbols are given to the same constituent portions as in the first embodiment.

In the scanner portion 16, or at the time a document which is made up by the PC as the external terminal is received by the input portion, the print ratio of the sheet is detected based on the pixels of the image data. If the print ratio is higher compared with a case in which the print ratio is low, the hourly toner consumption is larger. The more the toner consumption is, the more the toner replenishment amount becomes.

If the print ratio on a single side of a sheet of A4 size is 2~3%, for example, such a print ratio is assumed to be low. If the print ratio is low, the normal printing is used, and the rotational frequency of the agitating rollers 54, 55 is made 1.0 times the rotational frequency of the developing roller 52. On the other hands, if the print ratio is high in the case of a solid image, for example, the rotational frequency of the agitating rollers 54, 55 is made 1.5~2.0 times the rotational frequency of the developing roller 52. If the print ratio is not less than 20%, such a print ratio is assumed to be high, and if the print ratio is lower than 20%, such a print ratio is assumed to be low. In addition, the threshold value is not limited to 20%, but other values may be used.

Further, this third embodiment can be processed by itself. In addition to that, this process of the third embodiment may be combined to the process of the first embodiment or the second embodiment.

While certain embodiments have been described, those embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, although the separated two driving motors in this embodiment are used for the drive source to independently drive the developing roller and the agitating roller, a single motor with a clutch and gears for a mechanical multi-step speed change may be used.

What is claimed is:

1. An image forming apparatus, comprising:

an exposure portion to expose a surface of an image carrier to form an electrostatic latent image;

a developing device which includes an agitating roller to agitate a developer, a developing roller to transfer toner of the developer on a surface of the image carrier and a toner concentration sensor to detect a toner concentration, said developing device developing the electrostatic latent image formed on the image carrier to form a toner image;

a drive source to independently drive to rotate the developing roller and the agitating roller; and a control unit to control the drive source to change a rotational frequency of at least one of the developing roller and the agitating roller according to the toner concentration detected by the toner concentration sensor, wherein when the toner concentration detected by the toner concentration sensor is not more than a first threshold value, the control unit rotates the developing roller at a first rotational frequency, and rotates the agitating roller at a second rotational frequency which is larger than the first rotational frequency.

2. The image forming apparatus as recited in claim 1, wherein, when the toner concentration detected by the toner concentration sensor is not less than a second threshold value which is larger than the first threshold value, the control unit rotates the developing roller and the agitating roller at the first rotational frequency.

3. The image forming apparatus as recited in claim 1, wherein, at a toner compulsory replenishment time when a large amount of toner is replenished to the developing device, the control unit rotates the developing roller at a first rotational frequency and rotates the agitating roller at a second rotational frequency which is larger than the first rotational frequency.

4. The image forming apparatus as recited in claim 1, wherein, at a refresh replenishment time when a large amount of toner is replenished to the developing device, the control unit rotates the developing roller at a first rotational frequency and rotates the agitating roller at a second rotational frequency which is larger than the first rotational frequency.

5. The image forming apparatus as recited in claim 1, wherein, revolutions per minutes of the agitating roller is changed into higher, if the toner concentration detected by the toner concentration sensor is under a predetermined value.

6. The image forming apparatus as recited in claim 5, wherein, when a first process speed of the developing device is higher than a second process speed of the developing device, and revolutions per minutes of the agitating roller at the first process speed is faster than revolutions per minutes of the agitating roller at the second process speed.

7. The image forming apparatus as recited in claim 1, wherein, the first process speed is used for forming an image on a plain paper and the second process speed is used for forming an image on a heavy paper.

8. The image forming apparatus as recited in claim 1, wherein, revolutions per minutes of the agitating roller is changed according to an elapse time from a starting time of use of toner in a toner cartridge to a current time.

9. The image forming apparatus as recited in claim 1, further comprising, an input portion configured to input image information of a document;

wherein the control unit controls the drive source to change revolutions per minutes of the agitating roller according to a print ratio detected from the image information inputted in the input portion.

10. An image forming apparatus, comprising:

an exposure portion to expose a surface of an image carrier to form an electrostatic latent image;

a developing device which includes an agitating roller to agitate a developer, a developing roller to transfer toner of the developer on a surface of the image carrier and a toner concentration sensor to detect a toner concentration, said developing device developing the electrostatic latent image formed on the image carrier to form a toner image;

a drive source to independently drive to rotate the developing roller and the agitating roller; and a control unit to control the drive source to change a rotational frequency of at least one of the developing roller and the agitating roller according to the toner concentration detected by the toner concentration sensor, the control unit further changes the rotational frequency of the agitating roller for the rotational frequency of the developing roller according to a rotational frequency of the image carrier.

11. An image forming apparatus, comprising:

an input portion to input image information of a document;

an exposure portion to expose a surface of an image carrier to form an electrostatic latent image;

a developing device which includes an agitating roller to agitate developer and a developing roller to transfer toner of the developer on a surface of the image carrier, and develops the electrostatic latent image formed on the image carrier to form a toner image;

a drive source to independently drive the developing roller and the agitating roller to rotate; and a control unit to control the drive source to change a rotational frequency of at least one of the developing roller and the agitating roller according to a print ratio detected from the image information inputted in the input portion, wherein when the print ratio is not less than a threshold value, the control unit rotates the developing roller at a first rotational frequency, and rotates the agitating roller at a second rotational frequency which is larger than the first rotational frequency.

12. The image forming apparatus as recited in claim 11, wherein, when the print ratio is smaller than a threshold value, the control unit rotates the developing roller and the agitating roller at a first rotational frequency.

13. The image forming apparatus as recited in claim 11, further comprising, a toner concentration sensor configured to detect a toner concentration in the developing device, wherein, the rotational frequency of the agitating roller is changed to be higher if the toner concentration detected by the toner concentration sensor is under a predetermined value.

14. The image forming apparatus as recited in claim 11, wherein, when a first process speed of the developing device for a plain paper is higher than a second process speed of the developing device for a heavy paper, the rotational frequency of the agitating roller at the first process speed is faster than the rotational frequency of the agitating roller at the second process speed.

15. A toner replenishing method using a developing device accommodating a developer, which includes an agitating roller to agitate the developer, a developing roller, and a toner concentration sensor to detect a toner concentration, and said developing device develops an electrostatic latent image formed on an image carrier to form a toner image, comprising:

driving independently the developing roller and the agitating roller to rotate; and controlling a rotational frequency of at least one of the developing roller and the agitating roller to be changed according to the toner concentration detected by the toner concentration sensor, wherein when the controlling step further controls that a first process speed of the developing device is higher than a second process speed of the developing device, the rotational frequency of the agitating roller at the first process speed is faster than the rotational frequency of the agitating roller at the second process speed, and wherein the controlling step further controls the rotational frequency of the agitating roller is changed according to an elapse time from a starting time of using toner in a toner cartridge to a current time.

16. The toner replenishing method as recited in claim 15, further comprising, inputting image information of a document;

wherein the controlling step further controls a drive source to change the rotational frequency of the agitating roller according to a print ratio detected from the image information inputted in an input portion.

* * * * *